US009126715B2

(12) United States Patent
Horiuchi et al.

(10) Patent No.: US 9,126,715 B2
(45) Date of Patent: Sep. 8, 2015

(54) METALLIC SEALED DOUBLE CONTAINER

(75) Inventors: Saori Horiuchi, Hokuto (JP); Shinji Hayakawa, Hokuto (JP); Hiroo Shimizu, Hokuto (JP)

(73) Assignee: MIRAPRO CO., LTD., Hokuto (JP)

( * ) Notice: Subject to any disclaimer, the term of this patent is extended or adjusted under 35 U.S.C. 154(b) by 0 days.

(21) Appl. No.: 14/234,556

(22) PCT Filed: Aug. 16, 2012

(86) PCT No.: PCT/JP2012/070831

§ 371 (c)(1),
(2), (4) Date: Jan. 23, 2014

(87) PCT Pub. No.: WO2014/027412

PCT Pub. Date: Feb. 20, 2014

(65) Prior Publication Data

US 2014/0158683 A1 Jun. 12, 2014

(51) Int. Cl.
*F17C 3/08* (2006.01)
*B65D 1/40* (2006.01)
(Continued)

(52) U.S. Cl.
CPC ... *B65D 1/40* (2013.01); *F17C 3/08* (2013.01); *F17C 3/085* (2013.01); *F25D 3/10* (2013.01);
(Continued)

(58) Field of Classification Search
CPC ..... B65D 81/3806; B65D 81/3811; B65D 81/3841; B65D 81/3846; B65D 81/3876; B65D 81/3879; B65D 25/20; B65D 23/104; B65D 2313/02; A45C 2200/20; F17C 3/085; F17C 3/08; F17C 2203/018; F17C 2201/0119
USPC ..... 220/592.27, 601
See application file for complete search history.

(56) References Cited

U.S. PATENT DOCUMENTS 4,065,035 A * 12/1977 Eissler ..... 222/153.14
5,479,790 A * 1/1996 Bottum et al. ..... 62/503
(Continued)

FOREIGN PATENT DOCUMENTS

JP A-04-352404 12/1992
JP U-05-025254 4/1993
(Continued)

OTHER PUBLICATIONS

Nov. 20, 2012 International Search Report issued in International Application No. PCT/JP2012/070831 (with translation).
(Continued)

*Primary Examiner* — Stephen Castellano
(74) *Attorney, Agent, or Firm* — Oliff PLC

(57) ABSTRACT

The metallic sealed double container of the present invention includes an outer container, an inner container, an outer lid for the outer container, and an inner lid for the inner container, all of which being formed from thin metallic sheet. Connection holes are formed in the outer lid and the inner lid by burring, and both end parts of thin-walled pipes are respectively connected while inserted in the connection holes. The inner lid is joined to the inner container, and the outer lid is joined to the outer container, thereby constituting a metallic sealed double container in which the inner container is isolated in the outer container. As a result, the weight of the metallic sealed double container is reduced, the temperature in the inner container can be maintained over long periods of time, and the heat-insulating effect of the resulting sealed double container is high.

7 Claims, 5 Drawing Sheets

(51) Int. Cl.
*F25D 3/10* (2006.01)
*H01F 6/04* (2006.01)

(52) U.S. Cl.
CPC . *F17C 2201/0119* (2013.01); *F17C 2201/0195* (2013.01); *F17C 2201/032* (2013.01); *F17C 2201/056* (2013.01); *F17C 2203/018* (2013.01); *F17C 2203/0391* (2013.01); *F17C 2203/0395* (2013.01); *F17C 2203/0643* (2013.01); *F17C 2203/0646* (2013.01); *F17C 2203/0685* (2013.01); *F17C 2205/0188* (2013.01); *F17C 2270/0527* (2013.01); *H01F 6/04* (2013.01)

(56) References Cited

U.S. PATENT DOCUMENTS 5,634,256 A * 6/1997 Fritschi ..... 29/455.1
2009/0025400 A1* 1/2009 Barthelemy et al. ..... 62/49.1
2010/0213200 A1* 8/2010 Deane et al. ..... 220/592.2
2011/0127273 A1* 6/2011 Deane et al. ..... 220/592.2

FOREIGN PATENT DOCUMENTS

JP U-05-066418 9/1993
JP A-2000-258520 9/2000
JP A-2002-326674 11/2002
JP A-2010-096291 4/2010

OTHER PUBLICATIONS

Feb. 26, 2015 English translation of the International Preliminary Report on Patentability issued in International Application No. PCT/JP2012/070831.

* cited by examiner

METALLIC SEALED DOUBLE CONTAINER

This application is a national stage (Rule 371) of PCT/JP2012/070831 filed Aug. 16, 2012.

TECHNICAL FIELD

The present invention relates to a metallic sealed double container in which an inner container is disposed inside an outer container in an isolated manner.

BACKGROUND ART

In the past, metallic sealed double containers have been used as cooling devices for storing low-temperature heat sources such as a cooling medium in an inner container, or as heat storage devices for storing high-temperature heat sources in an inner container. In order to inhibit the transfer of heat from the inner container to the outer container, typical configurations that are often used involve providing an insulating material between the inner container and the outer container. In one configuration in which an insulating material is provided, heat-insulating effects are produced by maintaining a vacuum state between the inner container and outer container in a sealed double-container.

A superconductor cooling device (refer to patent document 1) and the like has been offered as a cooling device of such configuration, and a metallic vacuum double container (refer to patent document 2) and the like has been offered as a heat storage device.

With the invention described in patent document 1, the inner container and outer container are not constituted by a metallic material. Rather, the inner container and outer container are constituted by glass-fiber reinforced plastic. Thus, the bottomed tube-shaped body that constitutes the outer container and the outer container lid part are fixed using adhesive having epoxy resin as its primary component. In addition, the bottomed tube-shaped body that constitutes the inner container and the inner container lid part are fixed using an adhesive having epoxy resin as a primary component. Next, through-holes are formed in the lid part of the inner container and the lid part of the outer container, and a liquid nitrogen supply passage and nitrogen discharge passage that communicate with the internal space of the inner container respectively pass through these through-holes.

The liquid nitrogen supply passage and the nitrogen discharge passage have a double-wall configuration with an inner tube and outer tube, with foamed urethane inserted between the inner tube and outer tube. The inner container is fixed to the outer container with a fixing member interposed therebetween, and one end surface of the fixing member is fixed to the inner surface of the lid part of the outer container, whereas the other end surface is fixed to the outer surface of the lid part of the inner container. Fixing of the two end surfaces of the fixing members is achieved using an adhesive having epoxy resin as primary component.

The space between the inner container and the outer container is maintained in a substantially vacuum state. In addition, an activated carbon layer used for adsorption is provided on the outer circumferential surface of the inner container. A super-insulating layer for reflecting radiant heat is provided on the outer circumferential side of the activated carbon layer for adsorption. The super-insulating layer is a polyester resin film having an aluminum vapor deposition layer formed on one surface and a fibrous material such as paper formed on the other surface. A configuration is produced in which a polyester resin film is wound in innumerable layers on the outer circumferential side of the activated carbon layer for adsorption.

In the invention described in patent document 2, a double configuration is produced that comprises a metallic inner container and an outer container, with the space between the inner and outer containers being maintained in a vacuum state. A raised constriction part that is constricted towards the interior of the inner container is formed on the opening portion of the inner container. An inner end part of a mouth pipe is inserted and joined to the constriction part. An outer end part of the mouth pipe is joined to the opening part of the outer container. The opening part of the inner container is constituted by the mouth pipe.

A plug is inserted into the mouth pipe, producing a configuration in which the mouth pipe is stopped by the plug. A liquid outlet and liquid inlet that communicate with the internal space of the inner container are formed in the plug.

PRIOR ART DOCUMENTS

Patent Documents

Patent document 1: Japanese Unexamined Patent Application No. 2000-258520

Patent document 2: Japanese Unexamined Patent Application No. 2002-326674

DISCLOSURE OF THE INVENTION

Problems to be Solved by the Invention

With the superconductor cooling device described in patent document 1, the inner container and outer container are not constituted by a metallic material, but by glass-fiber reinforced plastic. The liquid nitrogen supply path and the nitrogen discharge path are of a double configuration having an inner tube and an outer tube, with foamed urethane inserted between the inner tube and the outer tube. In addition, an activated carbon layer for adsorption and a super-insulating layer are wound in multiple layers on the outer circumferential surface of the inner container. A configuration is produced in which the inner container is supported on the outer container via a fixing member.

Such a configuration requires the glass-fiber reinforced plastic that constitutes the inner container and outer container to be thick. Consequently, a configuration is produced in which the overall weight of the cooling device is increased, and the external form of the device is large.

In addition, a configuration is produced in which the cooling device is large in comparison to the amount of cooling medium that can be stored in the inner container. As a result, the amount of cooling medium that can be stored inside the inner container is small. It thus becomes difficult to maintain the temperature in the inner container over long periods of time.

In addition, when the inner container and outer container are constituted by a metallic material rather than glass-fiber reinforced plastic, a configuration is produced in which a thick sheet is used for the inner container and the outer container, and a thick sheet also is used for the lid part of the inner container and the lid part of the outer container. When the liquid nitrogen supply path and the nitrogen discharge path are constituted by metallic materials, it becomes difficult to maintain a joined state between the liquid nitrogen supply path and nitrogen discharge path that are constituted by the metallic materials and the lid part of the inner container and the lid part of the outer container, unless a joining member having a joining flange part is used.

As a result, the configuration produces a heavy superconductor cooling device, even when the inner container and outer container are constituted by metallic materials. In addition, the inner container is constituted by a thick sheet-form metallic material, and heat conduction from the inner container to the liquid nitrogen supply path and the nitrogen discharge path increases as the sheet thickness of the inner container increases, i.e., the rate of heat conduction increases as the contact area with the liquid nitrogen supply path and the nitrogen discharge path increases.

Accordingly, the proportion of heat in the inner container that escapes to the outer container increases, and it is difficult to maintain the temperature in the inner container over long periods of time.

With the metallic vacuum double container described in patent document 2, a configuration is used in which the internal space of the inner container communicates with the exterior of the outer container, and a plug is inserted into the mouth pipe that constitutes the opening part of the inner container. In addition, a liquid outlet and a liquid inlet are formed in the plug, and a configuration is used in which a press plate abuts the plug in order to prevent release of the plug. The press plate has a configuration in which it is connected to a bracket that is fixed to the outer circumferential surface of the outer container.

As a result, the configuration at the opening part of the inner container requires a mouth pipe or a plug and a press plate for preventing plug release, increasing the overall complexity of the configuration. In addition, a configuration is produced in which the surface area of the outer circumferential surface of the mouth pipe is larger than the surface area of the inner circumferential surface of the liquid outlet and liquid inlet. Moreover, transfer of heat between the inner container and the outer container and the outer part of the outer container occurs via the mouth pipe, the liquid inlet, and the liquid outlet.

For this reason, a large quantity of heat moves from the inner container to the outer container via the mouth pipe, the liquid inlet, and the liquid outlet. As a result, it is difficult to maintain the temperature in the inner container for long periods of time. A press plate for pressing the plug and a bracket for fixing the press plate also must be provided, which are factors in the increase in the weight of the metallic vacuum double container.

An aim of the present invention is to provide a metallic sealed double container with high heat insulation effects that resolves these problems, allowing the weight of the metallic sealed double container to be decreased and allowing the temperature in the inner container that stores a low-temperature or high-temperature heat source to be maintained over a long period of time.

Means Used to Solve the Above-Mentioned Problems

The aim of the present invention can be achieved by the metallic sealed double container according to claims 1 to 9.

Specifically, the present invention is a metallic sealed double container in which an inner container is disposed inside an outer container in an isolated state, and the main features thereof are that the inner container, the inner lid for closing the opening part of the inner container, the outer container, and the outer lid for closing the opening part of the outer container are all constituted by a thin metallic sheet material, the inner container is supported in the outer container by one or more thin-walled pipes that connect between the inner lid and the outer lid, both end parts of the thin-walled pipes being respectively joined to the inner lid and the outer lid while inserted into burred connection holes formed in the inner lid and outer lid, and the internal space in the inner container communicates with the exterior of the outer container through the thin-walled pipe.

In addition, a main feature of the present invention is that the inner container is formed in the shape of a cylinder, and the outer container is formed in the shape of a bellows-shaped cylinder.

In addition, a main feature of the present invention is that the metallic material that constitutes the thin-walled pipe is a metallic material having a lower thermal conductivity than the thermal conductivity of the metallic material that constitutes the inner lid and the outer lid.

In addition, a main feature of the present invention is that the thin-walled pipe comprises a plurality of pipes, the thin-walled pipes being disposed in a state of being isolated from each other.

In addition, a main feature of the present invention is that the inner container is disposed in a state of being suspended by the thin-walled pipe.

In addition, a main feature of the present invention is that the space between the outer container and the inner container is maintained in a vacuum state.

Effect of the Invention

With the metallic sealed double container of the present invention, the inner container, the inner lid that closes off the opening part of the inner container, the outer container, and the outer lid that closes off the opening of the outer container are all constituted by a thin metallic sheet material. In addition, a configuration is produced in which the inner container is supported by the outer container, and the pipe that communicates with the outside of the outer container through the inner space of the inner container is constituted by a thin-walled pipe. As a result of this configuration, it is possible to greatly reduce the weight of the metallic sealed double container.

In addition, a configuration is produced in which the two end parts of the thin-walled pipe respectively fit onto the inner lid of the inner container and the outer lid of the outer container that are constituted by a thin sheet, and burred connection holes are formed in the inner lid and outer lid. The thin-walled pipe is fitted onto the inner lid and the outer lid with both end parts of the thin-walled pipe having been inserted into the burred connection holes. For joining the thin-walled pipe, a well-known joining such as welding, brazing, or adhesion can be used.

By inserting the two end parts of the thin-walled pipe into the burred connection holes, a configuration can be produced in which the contact area resulting from joining of the connection holes and the thin-walled pipe is increased. Because of this configuration in which the contact area is increased, it is possible to increase the attachment strength of the thin-walled pipes, even though the inner lid and outer lid are constituted by a thin metallic sheet material.

As a result of this configuration, sufficient joining strength can be obtained, even though the thin-walled pipe is joined to the inner lid and outer lid constituted by thin sheet. It is thus possible to stably support the inner container in the outer container via the thin-walled pipe.

Moreover, because the thin-walled pipe and the inner lid that comes into contact with the thin-walled pipe are constituted by a thin sheet, conduction of heat from the inner lid to the thin-walled pipe is slowed, and conduction of heat from the thin-walled pipe to the outer lid also is similarly slowed. As a result, heat conduction from the inner container to the outer container through the thin-walled pipe is slow, and temperature loss in the inner container also is slow. Thus, the temperature in the inner container can be maintained over long periods of time without decreasing. As a result, a metallic sealed double container with high heat-insulating effects can be obtained.

In the present invention, the inner container can be formed in the shape of a cylinder, and the outer container can be configured in the shape of a bellows-shaped cylinder. As necessary, for example, the inner container also can be configured as a bellows-shaped cylindrical container when the inner container is to be configured as a high-volume container. For this reason, in the present invention, the cylindrical form pertaining to the inner container also encompasses a cylindrical bellows shape.

Because the inner container and outer container are configured as cylindrical containers, the strength of the containers can be increased, despite their being constituted by a thin sheet. Specifically, because uniform internal pressure is applied to the circumferential surface of the cylindrical surface in the cylindrical container, the strength of the inner container and outer container can be increased.

Moreover, because the container is configured as a bellows-shaped cylindrical container, the strength in the radial direction of the cylindrical container can be increased. Thus, sufficient strength can be maintained in the container, even though the large container is constituted by thin sheet.

With the present invention, the thin-walled pipe can be configured using metallic materials in which the thermal conductivity of the metallic material that constitutes the thin-walled pipe is lower than the thermal conductivity of the metallic material that constitutes the inner lid and the outer lid. Because heat transfer is slowed by the metallic material having low thermal conductivity, escape of heat in the inner container to the outer container can be inhibited, and the temperature in the inner container can be maintained at a prescribed temperature over a long period of time.

In the present invention, the metallic material that constitutes the inner container, the outer container, the inner lid, and the outer lid may be, for example, aluminum, an aluminum alloy, or stainless steel, and the thin-walled pipe may be constituted using, for example, a metallic material that has a lower thermal conductivity than aluminum, an aluminum alloy, or stainless steel, such as a zinc alloy, a tin alloy, or a heat-resistant magnesium alloy. Alternatively, the thin-walled pipe can be constituted by the same metallic material as the metallic material that constitutes the inner container, the outer container, the inner lid, and the outer lid.

With the present invention, the thin-walled pipe may be constituted by a plurality of pipes, and the respective thin-walled pipes that are constituted by numerous pipes may be disposed in a state in which they are isolated from each other. By using this configuration for the thin-walled pipe, the inner container is supported in the outer container in a stable state by a plurality of thin-walled pipes.

In addition, because the multiple thin-walled pipes are isolated from each other, transfer of heat between adjacent thin-walled pipes can be prevented. In addition, it is possible to use the respective thin-walled pipes for dedicated applications, such as a pipe for the discharge of cooling medium or a pipe for the supply of cooling medium to the interior of the inner container.

With the present invention, the configuration in which the inner container is supported in the outer container by a thin-walled pipe may be a configuration in which the inner container is suspended from the upper side by a thin-walled pipe, or a configuration in which the inner container is supported from below by the thin-walled pipe. The thin-walled pipe may also be used in order to support the inner container in the outer container in a condition whereby it floats.

As a result of this configuration, the inner container and outer container are connected via the thin-walled pipe, thereby greatly increasing heat insulation between the inner container and the outer container.

With the present invention, the space between the outer container and the inner container can be maintained in a vacuum state. Thus, the effect can be additionally heightened by employing vacuum insulation in a configuration in which the inner container and outer container are connected via a thin-walled pipe.

BEST MODE FOR CARRYING OUT THE INVENTION

Preferred embodiments of the present invention are described in detail below based on the accompanying drawings. Various modifications to the metallic sealed double container pertaining to the present invention may be made that are not described in the embodiments, and configurations are not restricted to those of the following embodiments, provided that they are within the technological scope of the invention of the application and that they achieve the aim of the present invention.

Figure 1:
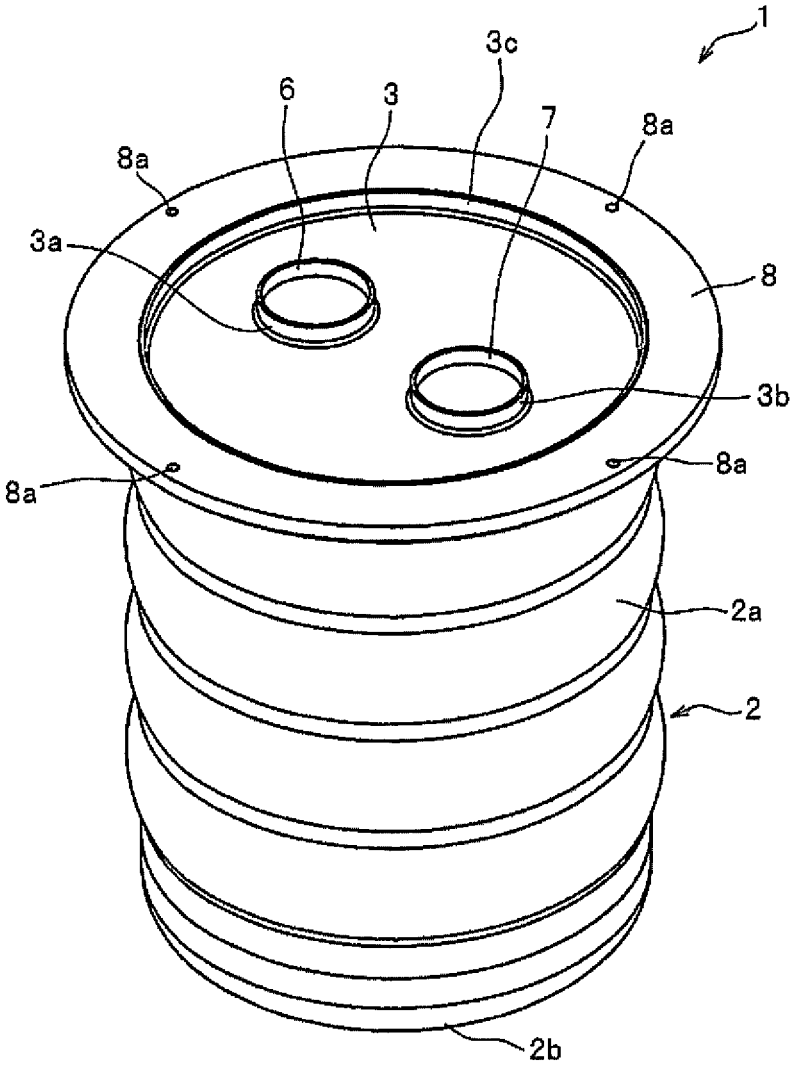
FIG. 1 is an oblique view of the metallic sealed double container. (Embodiment)
Figure 2:
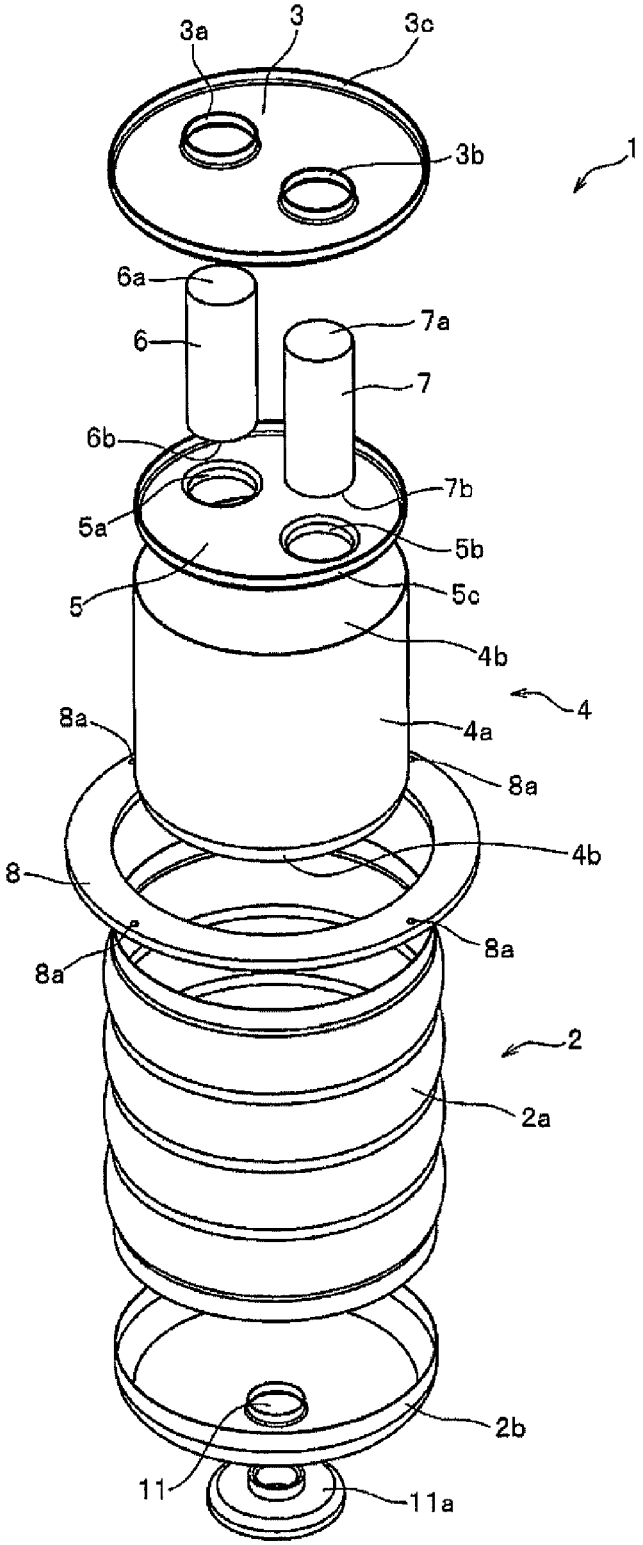
FIG. 2 is an exploded oblique view of the metallic sealed double container. (Embodiment)

As shown in FIGS. 1 and 2, the metallic sealed double container 1 has a configuration comprising an outer container 2 and an inner container 4 that is supported by a pair of thin-walled pipes 6, 7 inside this outer container 2. The outer container 2 and the inner container 4 are constituted by a thin metallic sheet material, and the outer container 2, the inner container 4, and the thin-walled pipes 6, 7 are constituted using aluminum, aluminum alloy, or stainless steel.

The thin-walled pipes 6, 7 may also be constituted using a metallic material such as zinc alloy, tin alloy, or heat-resistant magnesium alloy that has a lower thermal conductivity than the aluminum, the aluminum alloy, or the stainless steel.

As shown in FIG. 2, the outer container 2 has a configuration comprising a bellows-shaped cylindrical surface part 2*a*, an outer lid 3, and a bottom part 2*b*. The cylindrical surface part 2*a* is formed in a bellows shape along the longitudinal direction by drawing or the like. The upper end of the cylindrical surface part 2*a* has an attached thin sheet-form flange part 3*c* that has been formed at the outer circumferential edge of the outer lid 3, producing a configuration in which the opening at the top end of the cylindrical surface part 2*a* is closed off by the outer lid 3.

Because the outer lid 3 and the cylindrical surface part 2*a* are joined by the flange part 3*c*, a configuration can be produced in which the contact area between the cylindrical surface part 2*a* and the outer lid 3 is increased by the flange part 3*c*. Although the outer lid 3 and the cylindrical surface part 2*a* are constituted by a thin sheet, a configuration can be produced in which the contact area of the joining part is increased, making it possible to increase the joining strength between the outer lid 3 and the cylindrical surface part 2*a*.

Figure 4:
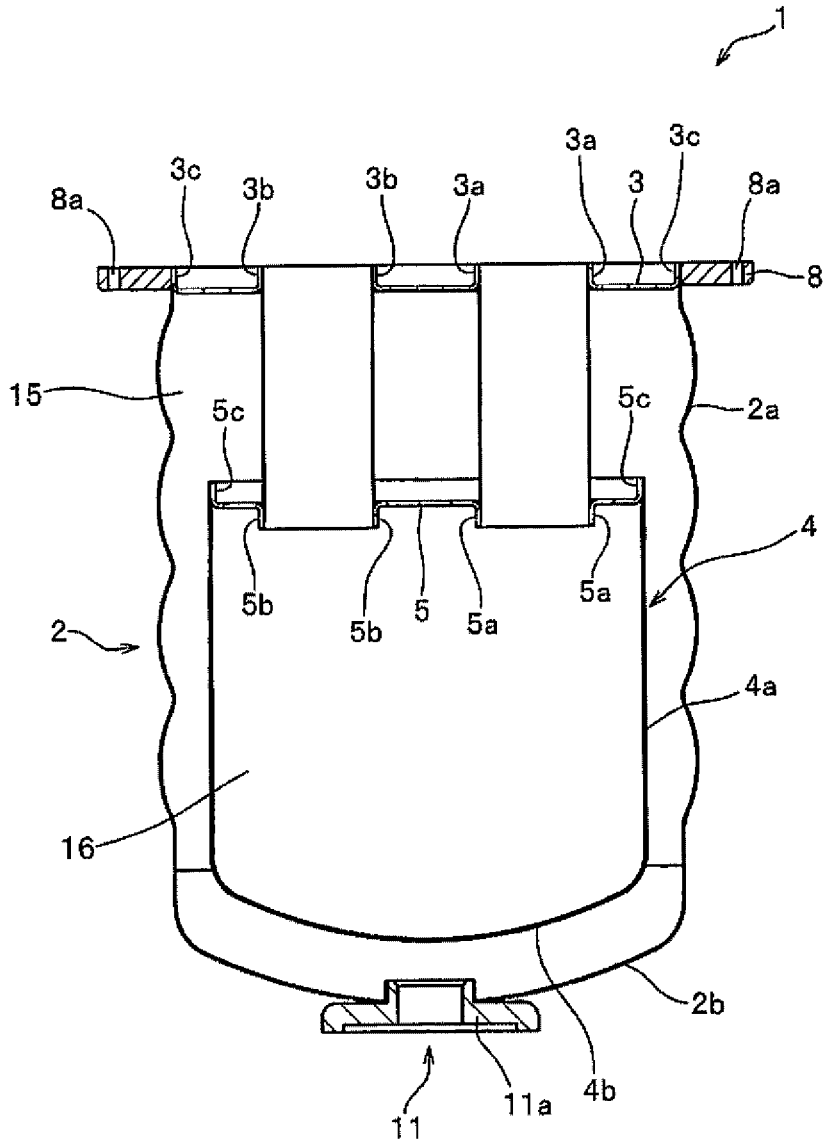
FIG. 4 is a sectional view across IV-IV in FIG. 3. (Embodiment)

A bottom part 2*b* that has been molded by drawing is attached to the bottom end of the cylindrical surface part 2*a*. As shown in FIG. 4, the connection part between the lower bottom end edge of the cylindrical surface part 2*a* and the edge part resulting from the raising of the outer circumferential edge of the bottom part 2*b* is joined by joining means such as welding, brazing, adhesion, or the like.

A pair of connection holes 3*a*, 3*b* are formed in the outer lid 3 by burring, and the end parts 6*a*, 7*a* of the pair of thin-walled pipes 6, 7 can be joined by being inserted respectively into the connection holes 3*a*, 3*b*. Because the connection holes 3*a*, 3*b* are formed by burring, the connection holes 3*a*, 3*b* can be configured to have a form with elevated parts that are raised from the outer lid 3.

A configuration can thus be produced in which the surface area of contact is increased in the joining part of the thin-walled pipes 6, 7 and the outer lid 3 constituted by thin sheet, and the joining strength between the outer lid 3 and the thin-walled pipes 6, 7 can be increased. In addition, the surface strength of the outer lid 3 can be increased by the pair of burred connection holes 3*a*, 3*b* and the flange part 3*c* that is formed at the outer circumferential edge of the outer lid 3.

The above description related to a configuration in which a pair of thin-walled pipes 6, 7 was used, but the number of thin-walled pipes is not restricted to two, as shown in the example of the drawing. The pipe may be constituted by a single thin-walled pipe, or by three or more thin-walled pipes. The number of thin-walled pipes that are disposed can be set in accordance with the application of the sealed double container 1.

Figure 3:
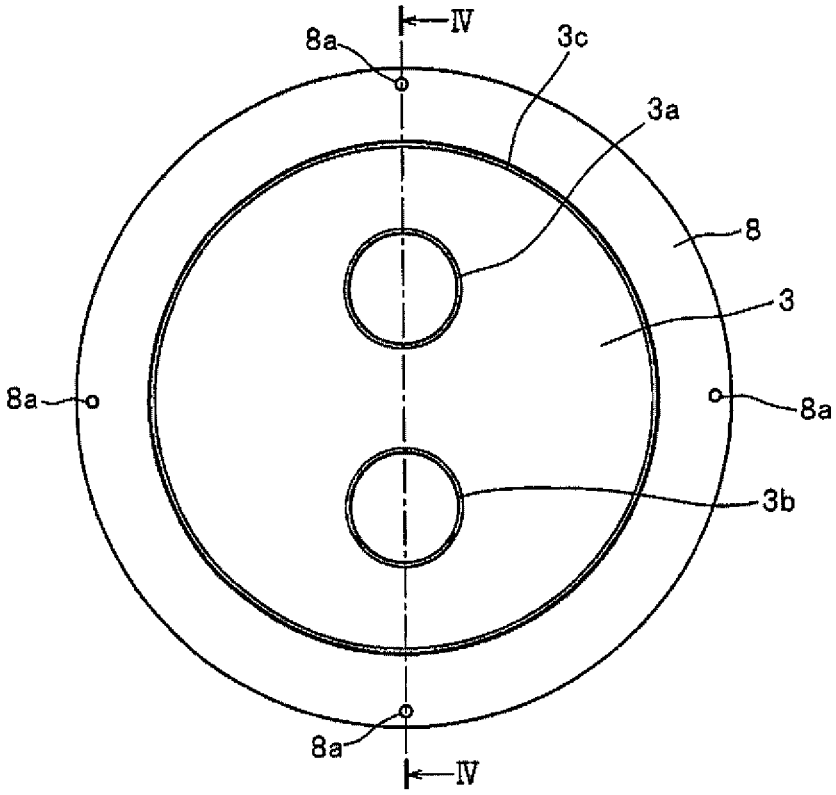
FIG. 3 is a plan view of the metallic sealed double container. (Embodiment)

As shown in FIGS. 1 and 3, an attachment flange 8 for attaching the sealed double container 1 to an external device or the like (not shown) is joined to an upper end part of the cylindrical surface part 2*a* to which the outer lid 3 has been attached. Multiple attachment holes 8*a* for attachment to external devices or the like (not shown) are formed in the circumferential direction on the attachment flange 8.

In the present invention, joining of the respective connection holes 3*a*, 3*b* with the end parts 6*a*, 7*a* of the thin-walled pipes 6, 7, joining of the cylindrical surface part 2*a* and the outer lid 3, joining of the cylindrical surface part 2*a* and the bottom part 2*b*, joining of the cylindrical surface part 2*a* and the bottom part 2*b*, and joining of the attachment flange 8 and the cylindrical surface part 2*a* may be carried out by welding, brazing, adhesion, or the like. In addition, various well-known joining methods may be suitably adopted.

A gas discharge port 11 is formed in the bottom part 2*b*, and, for example, a connection part 11*a* for connecting with a vacuum device is provided on the exhaust port 11. In order to increase the strength at the bottom part 2*b* when the space 15 between inner container 4 housed inside the outer container 2 (refer to FIG. 4) is placed in a vacuum state via the gas discharge port 11 as described below, the preferred shape for the bottom part 2*b* is a curved surface that protrudes outwards in a curved manner.

The inner container 4 that is housed in the outer container 2 has a configuration comprising a cylindrical surface part 4*a*, a bottom part 4*b*, and an inner lid 5. The cylindrical surface part 4*a* and the bottom part 4*b* are formed integrally by drawing or the like. In addition, in order to maintain the strength of the inner container 4, the bottom part 4*b* is formed in a curved shape that protrudes outwards in a curved manner.

A thin sheet-form flange part 5*c* that is formed at the outer circumferential edge of the inner lid 5 is attached to the top end of the cylindrical surface part 4*a*, producing a configuration in which the opening at the top end of the cylindrical surface part 4*a* is closed off by the inner lid 5.

By joining the inner lid 5 and the cylindrical surface part 4*a* via the flange part 5*c*, a configuration can be produced in which the contact area between the inner lid 5 and the cylindrical surface part 4*a* is increased by the flange part 5*c*. Although the inner lid 5 and the cylindrical surface part 4*a* are constituted by thin sheets, a configuration can be produced in which the contact area of the joining part is increased, and the joining strength between the inner lid 5 and the cylindrical surface part 4*a* can be increased.

A pair of connection holes 5*a*, 5*b* is formed in the inner lid 5 by burring, and joining can be carried out in a condition in which the other end parts 6*b*, 7*b* of the pair of thin-walled pipes 6, 7 are inserted into the connection holes 5*a*, 5*b*. Because the respective connection holes 5*a*, 5*b* are formed by burring, a configuration can be produced in which the respective connection holes 5*a*, 5*b* have shapes with elevated parts that are raised from the inner lid 5. In addition, the surface strength of the inner lid 5 can be increased by the pair of burred connection holes 5*a*, 5*b* and the flange part 5*c* that has been formed at the outer circumferential edge of the inner lid 5.

Thus, because a configuration can be produced in which the contact area is increased at the joining part between the inner lid 5 constituted by a thin sheet and the other end parts 6*b*, 7*b* of the thin-walled pipes, the joining strength between the inner lid 5 and the thin-walled pipes 6, 7 can be increased. Rather than forming the connection holes 5*a*, 5*b* and the connection holes 3*a*, 3*b* by burring, a configuration for joining the pair of thin-walled pipes 6, 7 that may be used involves enclosing the boundaries of the connection holes 3*a*, 3*b*, 5*a*, 5*b* with a joining member having flange parts. However, with configurations that involve using this type of joining member, the weight will increase in accordance with use of the joining members. As a result, it will not be possible to achieve a weight reduction in the metallic sealed double container.

With the present invention, a configuration is produced in which the inner container 4 is supported in a firmly suspended condition in the outer container 2 using a pair of thin-walled pipes 6, 7, without excessively increasing the weight. Thus, the internal space 16 (refer to FIG. 4) in the inner container 4 communicates with the exterior of the outer container 2 through the pair of thin-walled pipes 6, 7. Accordingly, a heat source can be supplied into the inner container 4, or heat source that is stored inside the inner container 4 can be used externally.

With the present invention, joining of the respective connection holes 5*a*, 5*b* and the other end parts 6*b*, 7*b* of the respective thin-walled pipes 6, 7 and joining of the inner lid 5 and the cylindrical surface part 4*a* can be carried out by suitably adopting various well-known joining means such as welding, brazing, or adhesion.

Although (not shown), an attachment part used for attachment may be provided on the connection holes 3*a*, 3*b* so as to allow mounting of a jig or the like for utilizing the heat source in the inner container 4, or to allow mounting of a supply device for supplying a heat source to the interior of the inner container 4 via the connection holes 3*a*, 3*b* in the outer lid 3.

In the present invention, the outer container 2, the inner container 4, and the pair of thin-walled pipes 6, 7 are constituted by a thin-walled metallic material, and so the weight of the sealed double container 1 can be greatly decreased. Moreover, a configuration is produced in which heat does not readily escape from the inner container 4 to the outer container 2.

Because the present invention is configured in this manner, the following experimental results were obtained as a result of comparing the sealed double container of the present invention and a comparative sealed double container, using metallic materials having the same properties and producing containers of the same size.

The comparative sealed double container had a configuration in which the outer container and inner container were constituted by a thin metallic sheet material, with the outer lid, inner lid, and the pipes connected to the outer lid and inner lid, being constituted by thick metallic sheet material.

Regarding the results of the experiment, the sealed double container pertaining to the present invention had a configuration in which the weight was less than half of the weight of the comparative sealed double container. In addition, concerning the retention time of cooling medium stored in the inner container, the retention time was at least three times greater than the retention time recorded for the comparative sealed double container. Specifically, with the comparative sealed double container, cooling medium was contained in an open state in the inner container for about 40 min, whereas the cooling medium remained in the inner container even after 2 hours with the sealed double container of the present invention.

Regarding the temperature in the inner container containing cooling medium, as stated above, the cooling medium remained in a free state for about 40 min with the comparative sealed double container, whereas the desired temperature could be maintained over a long period of time with the sealed double container of the present invention.

Comparative results relative to a comparative sealed double container were described above in a configuration example in which cooling medium was stored in the inner container 4. However, the metallic sealed double container of the present invention is not restricted to use as a sealed double container in which a low-temperature heat source such as cooling medium is stored in the inner container 4. The invention also can be suitably utilized as a sealed double container for storing a high-temperature heat source in the inner container 4.

Thus, the present invention allows the weight of the metallic sealed double container to be decreased and also allows the temperature of the inner container containing the low-temperature or high-temperature heat source to be maintained over long periods of time, thereby providing a metallic sealed double container with high heat insulating effects. Moreover, by using a configuration in which the cylindrical surface part 2*a* of the outer container 2 has a bellows shape, by using a flange part at the joining part, and by carrying out burring, a configuration can be produced in which the surface area of contact is increased between the joining members at the respective joining parts. As a result, the strength of the sealed double container 1 can be increased.

FIGS. 1 to 4 are used for describing the configuration in which the inner container 4 is suspended from the outer container 2 via thin-walled pipes 6, 7 inside the outer container 2. However, with the metallic sealed double container of the present invention, a configuration can be used in which the inner container 4 is supported from below in the outer container 2 via the thin-walled pipes 6, 7.

Figure 5:
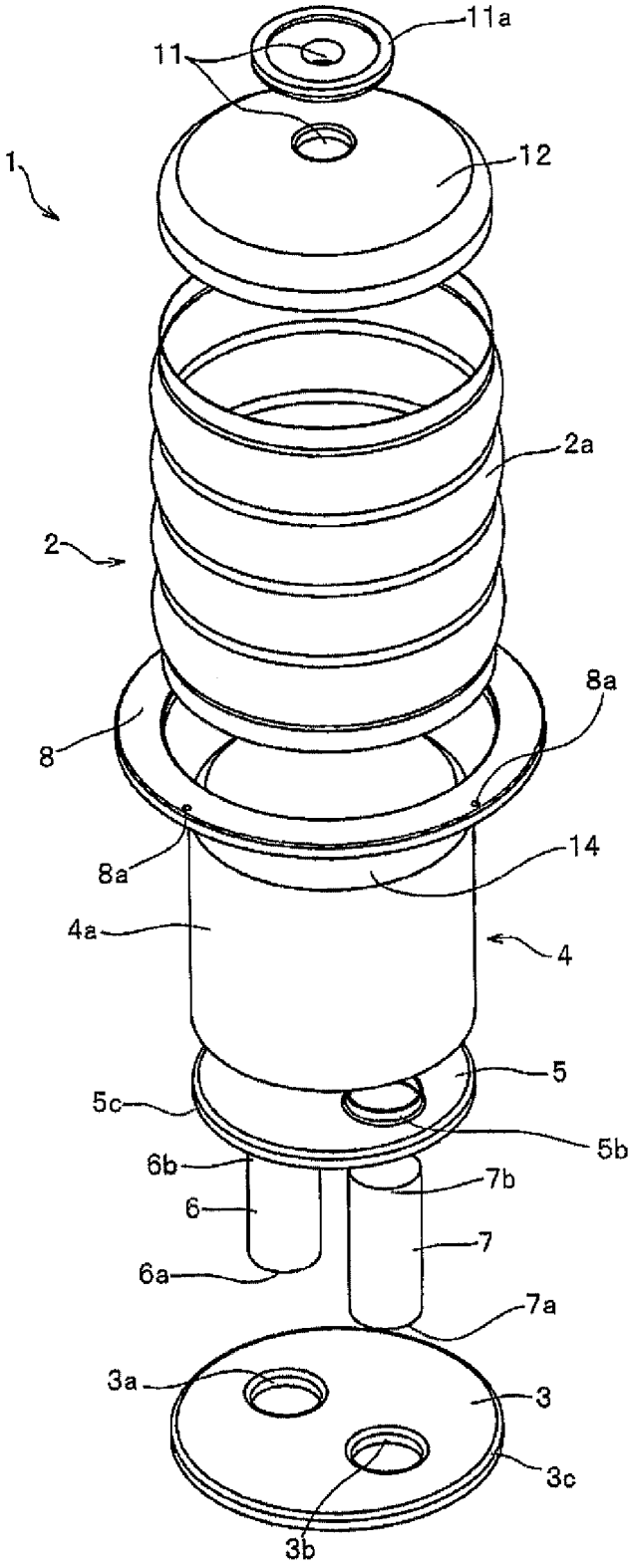
FIG. 5 is an exploded oblique view showing the configuration in which the inner container is supported from below. (Embodiment)

Specifically, as shown in FIG. 5, a configuration can be produced in which the inner container 4 is supported from below using a pair of thin-walled pipes 6, 7 that are joined to the outer lid 3 of the outer container 2. In such a case, the heat source that is stored in the inner container 4 can be supplied from one or both of the thin-walled pipes 6, 7 into the inner container 4.

In FIG. 5, the same symbols for the elements used in FIG. 2 are used for similar configurations as in FIG. 2. When the same symbols for elements are used, explanations for the configurations related to these elements are omitted.

With the configuration shown in FIG. 5 as well, joining of the pair of thin-walled pipes 6, 7 and the outer lid 3 and inner lid 5, joining of the outer lid 3 and the bellows-shaped cylindrical surface part 2*a*, joining of the cylindrical surface part 2*a* and the upper surface part 12, joining of the inner lid 5 and the cylindrical surface part 4*a*, and joining of the attachment flange 8 and the cylindrical surface part 2*a* are carried out by similar joining as described in the configuration in which the inner container 4 is suspended inside the outer container 2 as shown in FIG. 2.

In addition, the upper surface part 14 in the inner container 4 is integrally molded with the cylindrical surface part 4*a* by deep drawing. The upper surface part 12 of the outer container 2 is formed with a curved surface that protrudes outward in a curved manner, forming a gas discharge port 11.

With the present invention described above, a configuration was described in which the cylindrical surface part 4*a* of the inner container 4 was formed in the shape of a non-bellows-shaped cylindrical surface. However, in cases where the inner container 4 is of large size and it is necessary to increase the strength in the cylindrical surface part 4*a*, a configuration can be used, as necessary, in which the cylindrical surface part 4*a* is formed as a bellows-shaped cylindrical surface part.

Moreover, although a configuration example was described in which curved surfaces that protrude outwards in a curved manner were used for the bottom part 2*b* of the outer container 2 and the bottom part 4*b* of the inner container 4 as shown in FIG. 2, or for the top surface part 12 of the outer container 2 and the top surface part 14 of the inner container 4 as shown in FIG. 5, these surfaces can be recessed curved surfaces having shapes that curve inwards.

Specifically, any configuration can be adopted, provided that it is a configuration whereby the strength of the outer container 2 and the inner container 4 are maintained.

INDUSTRIAL APPLICABILITY

The present invention can be suitably utilized for metallic sealed double containers.

KEY

1: Sealed double container
2: Outer container
2*a*: Cylindrical surface part
3: Outer lid
3*a*, 3*b*: Connection holes
4: Inner container
4*a*: Cylindrical surface part
4*b*: Bottom part
5: Inner lid
5*a*, 5*b*: Connection holes
6, 7: Thin-walled pipes
12: Top surface part
14: Top surface part

The invention claimed is:

1. A metallic sealed double container in which an inner container is disposed inside an outer container in an isolated state, wherein:

the inner container is formed in a cylindrical shape and has an opening part, the inner container being constituted by a thin metallic sheet material;

an inner lid, which is different from the inner container, is attached to the inner container to close the opening part of the inner container, the inner lid being formed by a thin metallic sheet material;

the outer container is formed in a cylindrical bellows shape and has an opening part, the outer container being constituted by a thin metallic sheet material;

an outer lid, which is different from the outer container, is attached to the outer container to close the opening part of the outer container, the outer lid being formed by the thin metallic sheet material;

the inner container is supported in the outer container by one or more thin-walled pipes that connect between the inner lid and the outer lid;

both end parts of the thin-walled pipes are respectively joined to the inner lid and the outer lid while inserted into connection holes formed in the inner lid and outer lid, each connection hole, which extends in an axial direction of the thin-walled pipe and is formed by a burring process, has a shape with a projecting part that is bent from a flat portion of the lid;

the internal space in the inner container communicates with the exterior of the outer container through the thin-walled pipe, and the thin-walled pipe is a metallic material having a lower thermal conductivity than the thermal conductivity of the metallic material that constitutes the inner lid and the outer lid.

2. The metallic sealed double container according to claim 1, wherein the thin-walled pipe comprises a plurality of pipes, the thin-walled pipes being disposed in a state of being isolated from each other.

3. The metallic sealed double container according to claim 2, wherein the inner container is disposed in a state of being suspended by the thin-walled pipe.

4. The metallic sealed double container according to claim 2, wherein the space between the outer container and the inner container is maintained in a vacuum state.

5. The metallic sealed double container according to claim 1, wherein the inner container is disposed in a state of being suspended by the thin-walled pipe.

6. The metallic sealed double container according to claim 1, wherein the space between the outer container and the inner container is maintained in a vacuum state.

7. The metallic sealed double container according to claim 1, wherein the outer lid is formed by a substantially flat plate.

* * * * *